United States Patent [19]

Dickson

[11] Patent Number: 4,802,425

[45] Date of Patent: Feb. 7, 1989

[54] HIGH TEMPERATURE FIBER SYSTEM WITH CONTROLLED SHRINKAGE AND STRESS RESISTANCE

[75] Inventor: Edwin J. Dickson, Augusta, Ga.

[73] Assignee: The Babcock & Wilcox Company, New Orleans, La.

[21] Appl. No.: 450,401

[22] Filed: Dec. 16, 1982

[51] Int. Cl.[4] ..... F23M 5/00

[52] U.S. Cl. ..... 110/336; 266/280

[58] Field of Search ..... 52/506, 510, 447, 404, 52/596, 612; 110/336, 357; 432/247; 126/144, 147, 151; 428/112; 266/280, 285

[56] References Cited

U.S. PATENT DOCUMENTS

| | | | |
|---|---|---|---|
| 1,377,710 | 5/1921 | Meyerhoffer | 432/247 |
| 1,852,162 | 4/1932 | Harris et al. | 266/280 |
| 2,024,595 | 12/1935 | Petit | 52/506 |
| 2,640,503 | 6/1953 | Milligan | 266/280 |
| 3,528,400 | 9/1970 | Norwalk | 126/144 |
| 3,819,468 | 6/1974 | Sauder et al. | 52/270 |
| 3,990,203 | 11/1976 | Greaves | 52/506 |
| 4,123,886 | 11/1978 | Byrd, Jr. | 52/506 |
| 4,242,406 | 12/1980 | ElBouhnini et al. | 52/612 |
| 4,268,015 | 5/1981 | Lührsen et al. | 266/285 |
| 4,324,602 | 4/1983 | Davis et al. | 52/506 |
| 4,336,086 | 6/1982 | Rost | 52/506 |
| 4,339,902 | 7/1982 | Cimochowski | 52/506 |
| 4,379,382 | 4/1983 | Sauder | 52/506 |
| 4,381,634 | 5/1983 | Hounsel et al. | 52/506 |
| 4,411,621 | 10/1983 | Miller | 432/247 |
| 4,440,099 | 4/1984 | Brachet et al. | 110/336 |

*Primary Examiner*—John E. Murtagh
*Assistant Examiner*—Andrew J. Rudy
*Attorney, Agent, or Firm*—Robert J. Edwards; Michael L. Hoelter; D. Neil LaHaye

[57] ABSTRACT

An apparatus for lining the interior of a furnace or the like having a hot and a cold face comprising alternating strips of two fibrous materials stacked edgewise to form the insulative module or mat. The first fibrous material exhibiting either greater shrinkage or corrosion resistance than the second fibrous material, and the alternating pattern allowing the lining to be used in conditions which would normally exceed the use characteristics of the second material.

4 Claims, 1 Drawing Sheet

HIGH TEMPERATURE FIBER SYSTEM WITH CONTROLLED SHRINKAGE AND STRESS RESISTANCE

BACKGROUND AND SUMMARY OF THE INVENTION

The present invention relates to a method and apparatus for insulating the interior of a high temperature furnace and more particularly to an insulating mat or module for lining a furnace.

The problems involved in insulating the interior of a high temperature furnace are well known. Historically, the interiors of high temperature furnaces have been lined with various types of bricks capable of withstanding these high temperatures. When the brick lining wears out, however, it is an arduous and time-consuming task to replace the old brick with a new brick lining. On the other hand, efforts have been made to insulate the interior of a furnace with insulation which includes or consists of ceramic fiber material.

Refractory material, containing a high percentage of alumina and silica, has been produced in fibrous form and felted into blankets of various thickness and density. When used as an insulation layer, this alumina-silica material is characterized by good retardation of heat flow from the interior of furnaces to the outer surfaces of furnaces. Also, because of the very light density of the fibrous blanket, a furnace lined with such material stores a very small amount of heat in the furnace lining and thus permits rapid rates of heating and cooling with a concomitant of heat saving, especially when a process heating furnace is frequently cycled up and down in temperature.

Unfortunately, ceramic fiber blankets, which have heretofore been produced, are not mechanically strong. This material must be handled with great care to avoid tearing. Furthermore, the ceramic fiber blankets have differing values of mechanical strength depending upon the orientation of fibers with respect to the direction of applied forces, the relative amounts of alumina and silica and the heat treatment to which they have been exposed.

Ceramic fiber blankets are characterized by greater strength in a direction parallel to the surface of the blanket than transverse to these surfaces. Furthermore, because of the manner in which the ceramic fibers are felted to form blankets, the blankets are somewhat lamellar in structure and thus prone to easy separation in layers substantially parallel to the surfaces of the blanket. Thus, the ceramic fiber blanket material can be arranged in a manner as to take advantage of the superior strength in a direction substantially parallel to the surfaces of the blanket and in a manner to eliminate the peeling type deterioration of the blanket along lamellar plates.

Ceramic fiber blanket material is known to shrink when exposed to temperatures in excess of 2,000° F. Previous methods for utilization of blankets of insulation fibers to the lining of furnaces have encountered difficulties caused by said shrinkage of the material. Separations or fissures transverse to the hot face of the furnace lining are often produced. Such fissures readily pass heat from the interior of the furnace towards the furnace shell resulting in unacceptable heat losses.

The prior art broadly discloses the feature of re-orienting fiber insulation, for examle U.S. Pat. No. 3,819,468 (Saunder et al) and U.S. Pat. No. 3,832,815

(Balaz et al), both show the cutting of strips of fibrous material from a sheet or blanket of ceramic fiber material, arranging the strips in side-by-side relation to provide an end fiber exposure in order to take advantage of the fiber's strength and insulative properties. However, furnace linings made in accordance with these teachings are composed of ceramic fibers which at elevated temperatures lack either the mechanical strength or the insulative properties or shrinkage resistance necessary to produce an enduring insulative product.

In accordance with the present invention, there is disclosed a furnace lining having a hot and cold face in the form of a mat or plurality of modules comprised of alternating strips of two fibrous materials. A first fibrous material is chosen for its shrinkage or corrosion resistance during high temperature use while the second fibrous material is chosen for its superior mechanical strength. The alternating strips of these two fibrous materials can be supported by an anchoring system or by veneering methods of cementing them to existing structures.

It is an object of this invention to provide a new and improved mat or insulative module lining which is composed of two fibrous materials having different properties yet exhibits the superior qualities of each type of fibrous material.

It is a further object of this invention to provide a furnace lining construction technique which increases the temperature use limit and the life of the fiber lining.

DESCRIPTION OF THE PREFERRED EMBODIMENTS

Figure 1:
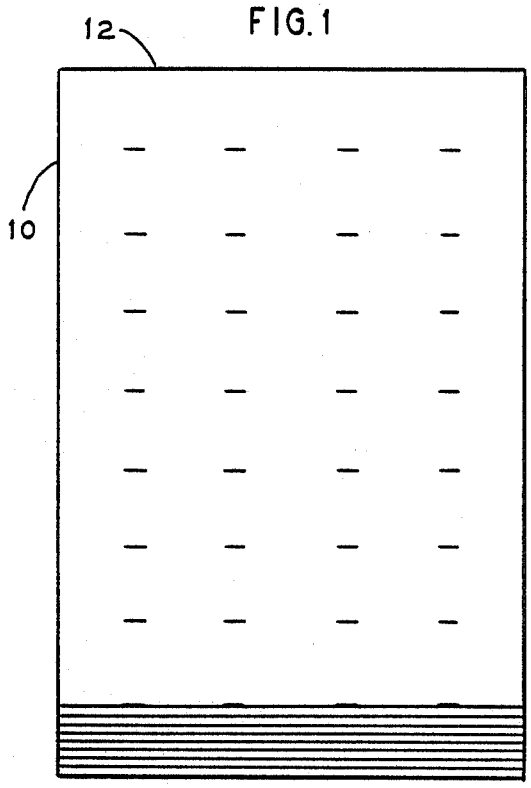
FIG. 1 is a plan view of an insulating module made from alternating strips of two ceramic fiber blankets and placed within a soaking pit cover.

The present invention provides a new and improved insulating block and a method for lining a wall of a furnace or like equipment. The term "wall" should be construed as covering any side wall or ceiling, removable or fixed, or area surrounding any access opening and any other surface on the interior of the high temperature chamber where insulation is required. The ceramic fiber insulation is made up of strips which are cut transversely from a length of ceramic fiber blanketing which is commercially available. The strips are cut from the fiber blanket in widths that represent the thickness of the insulation once in place. The cut strips are placed on edge and laid lengthwise adjacent to similar sized strips which are cut from a fibrous blanket of different shrink resistant, or insulative or mechanical properties. The strips of alternating fibrous material are laid edgewise to each other until mat or module of the desired width is created. Naturally, the thickness of the fiber blanket from which the strips are cut will determine the number of strips required to construct the mat. The mat or module can be applied to the furnace wall by a mounting means of a bracket and stud welding or by ceramic cement, mortar, or the like.

This invention has particular application for the internal insulation of furance walls of high temperature furnaces. For the purposes of the present invention, "high temperature" will mean temperature in excess of 1600° F. and, preferably, in the range of 1600° F. to 2800° F. The fibrous strips used in the present invention are cut from ceramic fiber blankets which are manufactured under the trademarks KAOWOOL (The Babcock & Wilcox Company) and SAFFIL (Imperial Chemical Industries, Ltd.), though there are several other commercially available alumina-silica, aluminosilicate, chemically treated fiber such as chromium treated alumina-silica, silica and zirconia ceramic fibrous blankets which can be used. As the use temperature increases, the type of fibrous material used in accordance with this invention changes, i.e., from a standard KAOWOOL ceramic fiber of 45% $Al_2O_3$, 52% of $SiO_2$ and 3% impurities to a high purity ceramic fiber. KAOWOOL ceramic fibers shrink in the order of 8% when exposed to temperatures in excess of 2400° F., however, they exhibit less brittleness and therefore greater handleability and mechanical strength than most ceramic fibers. SAFFIL alumina fibers (95% $Al_2O_3$, 5% $SiO_2$) exhibit shrinkage in the order of 1% when exposed to 3000° F. and has a temperature use limit of 2800° F., however, it lacks the mechanical strength exhibited by KAOWOOL fibers. It has been found that the combination of alternating strips of a first and second fibrous material, the first material having a greater shrink resistance than the second material, results in a fibrous lining exhibiting the shrink resistance of a lining composed entirely of the first fibrous material. It is believed that the frictional forces between the two types of fibers at the compressed strip - strip interface of the two fibers prevents the second type of fibers from cumulatively shrinking. Since the two types of fibers are randomly intermingled at the strip - strip interface, the second fiber having less shrinkage resistance, is unable to cumulative shrink by the degree it would naturally shrink if in a module composed only of similar fibers.

Referring to FIG. 1, shown in a portion of an insulating module 10 which has been placed in soaking pit cover 12. The module 10 is composed of a plurality of alternating strips 20 and 22; the strips 20 and 22 are both fibrous materials but have different insulative, shrink or corrosion resistance, and/or strength properties. As indicated herein, these fibrous blankets are generally provided in widths of several feet, of a thickness ranging from one-sixtenth of an inch to three inches and of almost any desired length. When the strips are cut from the blanket forms, they are cut in a direction of the thickness perpendicular to the length or width of blanket.

Figure 2:
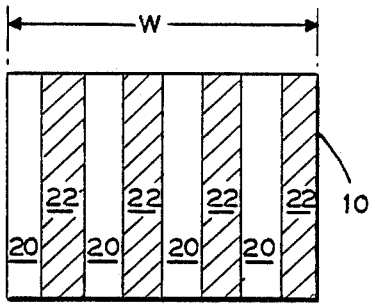
FIG. 2 is an end elevation of the ceramic fiber module as shown in FIG. 1.
Figure 3:
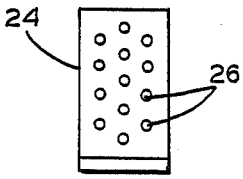
FIGS. 3 and 4 are plan views of an individual bracket and tyne in accordance with the present invention.
Figure 4:
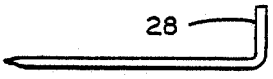

Once the strips 20 and 22 are cut from their respective fibrous blanket, they are alternatively placed edgewise adjacent each other until the desired width of the mat is obtained as shown in FIG. 2. These strips are then compressed to the desired width W and held in compression by means not shown. The soaking pit cover 12 is filled with the alternating strips or modules until the entire cover is filled with the insulative material. It has been found that for easy installation it is best to premake compressed modules in desired widths so that installation can proceed more rapidly. FIG. 3 and 4 show the mounting means used when the inventive concept is used in a soaking pit cover. Brackets 24, made of angle iron, are welded in uniform spaced relationship with respect to each other. Each bracket 24 has a plurality of holes 26 placed in the upright portion thereof. The compressed module 10 is then placed in the soaking pit cover 12 between two rows of brackets and a tyne 28 is placed between two adjacent brackets 24 thereby piercing the module 10 near its cold face. The tyne 28 can be positioned within any of the holes 26 of bracket 24. Generally it is thought best to combine a high temperature shrink resistant, alumina fibrous material (SAFFIL) with a lower temperature (with attendant lower cost) ceramic fiber material having a mechanically stronger fibers (KAOWOOL). Thus, as discussed above the fibers having greater shrink resistant prevent the second fibers from cumulatively shrinking while the second mechanically stronger fiber secures the whole system to the tynes. In order to improve the durability of the fiber lining, a coating is used on the hot face to improve the abrasion and chemical resistance thereof. These coating, though important in that they extend the life of the furnace fibrous lining, do not contribute to the frictional forces which reduce the shrinkage of the one fibrous material which is not in contact with the coating, however, they can shield fibrous material susceptible to chemical corrosion from furnace gases.

Figure 5:
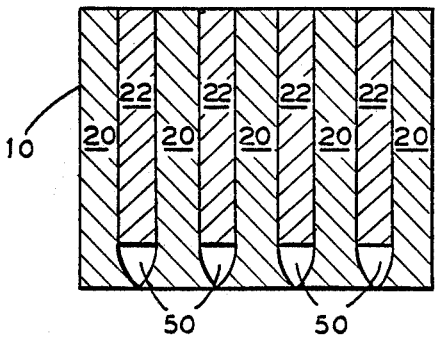
FIG. 5 is an alternate embodiment of the present invention.

Shown in FIG. 5 is an alternative embodiment of the alternating fibrous lining in accordance with the present invention. In particular, the end view of a module is shown, having two distinct fibrous materials 20 and 22. In this embodiment, fibrous material 20 is cut from its blanket in widths greater than the width of material 22. Thus, as shown in FIG. 5, alternating strips 20 and 22 are flush with adjacent strips at the cold face end and uneven at the hot face ends. Since the materials are cut with different widths the hot face of a module made of these two materials will be uneven. Fibrous material 20 will tend to fluff out in that portion which extends beyond the width of material 22. This portion of module 10 tends to shield the fibrous material 22 from direct contact with the furnace heat or gases, thereby, allowing the use of a mechanically stronger yet less shrink or corrosive resistant material to be used in an application which it could normally not survive if used alone. The relative thickness of two materials is determined by the fluffiness of the material to be used as the shielding material. As shown, it has been found that air pockets 50 naturally form at the hot face ends of fibrous material 22 since material 20 gradually expands in its uncompressed hot face end.

EXAMPLE

Panels were prepared for testing a furnace ceiling made of alternating ceramic fiber in accordance with this invention. Half of the furnace ceiling was lined with a 100% SAFFIL mat and the other half lined with a mat prepared with alternating SAFFIL and KAOWOOL ST (a specially treated KAOWOOL ceramic fiber blanket which exhibits reduced shrinkage) fiber strips. The ten inch thick KAOWOOL ST and SAFFIL fiber strips were attached to the furance ceiling using metal anchors. The two mats were joined in the center of the arch with a three inch shiplap which was covered with a SAFFIL mat roll attached to the arch at the center joint using ceramic studs and washers. The furnace was then fired to 2400, 2500, 2600, and 2700° F. for 5 hours at each temperature. After firing of the arch was inspected and found to be in excellent condition. The shrinkage that had occurred both in the 100% SAFFIL mat and the SAFFIL-KAOWOOL ST mat was comparable and in the order of 1%.

Those skilled in the art will also realize that this inventive concept can be used with the same fibrous material having different grades thereof, thus extending the use limit of the lower graded material to that of the higher grade material. Hence a KAOWOOL ceramic fiber rated at 2600° F. can be used with a KAOWOOL ceramic fiber rated 2300° F., the result being that a lining made in accordance with this invention will exhibit the shrink resistant properties of the higher grade KAOWOOL 2600 ceramic fiber.

The above-described description and drawings are only illustrative of a preferred embodiment which achieves the objects, features and advantages of the present invention, and it is not intended that the present invention be limited thereto. Any modifications of the present invention which come within the spirit and scope of the following claims are considered part of the present invention.

The embodiments of the invention in which an exclusive property or privilege is claimed are defined as follows:

1. A fibrous lining for an interior of a furnace or the like, said lining having a hot and cold face, said lining comprising:

alternate strips of a first fibrous material, a second fibrous material material mechanically stronger than said first material but less shrink resistant then said first material and means for attaching the strips to a furnace wall such that the alternating strips of a first and second fibrous material, laid edgewise, form the hot face of the lining to provide a fibrous lining exhibiting the shrink resistance of a lining composed entirely of said first fibrous material.

2. The fibrous lining in accordance with claim 1 wherein the first fibrous material has a higher alumina content than the second fibrous material.

3. The fibrous lining in accordance with claim 1 wherein the first fibrous material has greater chemical and hot gas corrosion resistance than the second fibrous material.

4. A fibrous lining for an interior of a furnace or the like comprising alternating strips of the first and second fibrous materials having hot and cold face ends, said first fibrous material being more shrink resistant but mechanically weaker than said second fibrous material, said alternating strips being flush with adjacent strips at the cold face ends and uneven at the hot face ends, such that the first fibrous material cover the hot face ends of the second fibrous material and provides a fibrous lining exhibiting the shrink resistance of a lining composed entirely of said first fibrous material.

* * * * *